US008099034B2

(12) United States Patent
Tsukamoto et al.

(10) Patent No.: US 8,099,034 B2
(45) Date of Patent: Jan. 17, 2012

(54) FIXING APPARATUS

(75) Inventors: Kimihide Tsukamoto, Osaka (JP); Hirokazu Nakamura, Osaka (JP); Takashi Yamanaka, Osaka (JP); Kousuke Namisaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 435 days.

(21) Appl. No.: 12/486,774

(22) Filed: Jun. 18, 2009

(65) Prior Publication Data

US 2009/0324307 A1 Dec. 31, 2009

(30) Foreign Application Priority Data

Jun. 25, 2008 (JP) ..... 2008-165968

(51) Int. Cl.
*G03G 15/20* (2006.01)

(52) U.S. Cl. ..... 399/328; 399/67; 399/320; 399/329

(58) Field of Classification Search ..... 399/67, 399/320, 328, 329
See application file for complete search history.

(56) References Cited

U.S. PATENT DOCUMENTS 4,363,549 A * 12/1982 Brown et al. ..... 399/332
6,253,046 B1 * 6/2001 Horrall et al. ..... 399/124
2007/0019977 A1 * 1/2007 Sawamura et al. ..... 399/67
2007/0223977 A1 * 9/2007 Matsubara et al. ..... 399/329
2008/0181686 A1 * 7/2008 Geyling et al. ..... 399/329

FOREIGN PATENT DOCUMENTS

JP 02-282773 11/1990
JP 2003-280308 10/2003

* cited by examiner

*Primary Examiner* — David Gray
*Assistant Examiner* — Francis Gray
(74) *Attorney, Agent, or Firm* — Renner, Otto, Boisselle & Sklar, LLP

(57) ABSTRACT

In one embodiment, when a hot roller is driven to rotate, a driving gear rotates so that a swing gear and a swing cam rotate. Then, a sliding contact edge on the right side of a swing lever that abuts against the circumferential face of the swing cam repeatedly moves up and down, and the swing lever repeatedly rotates clockwise and counterclockwise with a shaft of a pressure release cam as the center. At this time, since only the clockwise rotation of the swing lever is transmitted via a one-way clutch to the shaft of the pressure release cam, the clockwise rotation is intermittently transmitted to the shaft of the pressure release cam. As a result of this, the pressure release cam intermittently rotates clockwise, and the pressure release cam pushes away a roller of a displacement frame, so that the pressure roller separates from the hot roller.

3 Claims, 8 Drawing Sheets

FIXING APPARATUS

CROSS-REFERENCE TO RELATED APPLICATIONS

This application claims priority under 35 U.S.C. §119(a) on Patent Application No. 2008-165968 filed in Japan on Jun. 25, 2008, the entire contents of which are herein incorporated by reference.

BACKGROUND OF THE INVENTION

1. Field of the Invention

The present invention relates to a fixing apparatus that is applied in an image forming apparatus using an electrophotographic method, such as a copying machine, a facsimile, or a printer.

2. Related Art

In an image forming apparatus of this type using an electrophotographic method, an electrostatic latent image is formed on the surface of a photosensitive drum. Then, the electrostatic latent image on the surface of the photosensitive drum is developed using toner, and a toner image is thereby formed on the surface of the photosensitive drum. Thereafter, the toner image is transferred from the photosensitive drum onto recording paper, the recording paper is heated and pressed, and then the toner image is fixed onto the recording paper.

A fixing apparatus fixes a toner image onto recording paper. In the fixing apparatus, recording paper is sandwiched in a nip region between a hot roller and a pressure roller, which form a pair, and is transported. Accordingly, the recording paper is heated and pressed by the rollers, so that toner on the recording paper is heated and melted so as to be fixed.

In the fixing apparatus as described above, in order to retain the width of the nip region between the hot roller and the pressure roller and stably maintain the nip region, by covering the rollers with an elastic layer, the elastic layers of each roller are pressed against each other and deformed.

However, since the pressure between the rollers is large, when the fixing apparatus is not used and the rollers are in a stopped state for a long time, the elastic layers of the rollers are left deformed and sometimes unable to return to their original shape, thus forming depressions in the elastic layers of the rollers.

Consequently, for example, JP 2003-280308A discloses a configuration in which a hot roller and a pressure roller are separated when the rollers are stopped so as to prevent the elastic layers of the rollers from being left deformed. In that configuration, a frame body that axially supports a pressure roller is movably supported, a cam that slidingly contacts this frame body is provided, the frame body is moved by this cam and, thereby, the pressure roller can be separated from the hot roller. When a fixing operation is performed, the forward rotation of an output shaft of a driving motor is transmitted to the hot roller via a gear unit and a one-way clutch, and then recording paper is sandwiched in the nip region between the rollers and transported. Also, when a fixing operation is not performed, backward rotation of the output shaft of the driving motor is transmitted to the cam via another gear unit and another one-way clutch, the frame body is moved by the cam, and then the pressure roller is separated from the hot roller. As a result of this, it is possible to switch and perform rotational driving of the rollers and an operation to bring the rollers into and out of contact with each other by using one driving motor.

Meanwhile, a driving motor of a fixing apparatus is not always used only for the fixing apparatus, and is often used for driving the rotation of the rollers for transporting recording paper on an upstream side and downstream side in the recording paper transport direction, or the rollers for developing and transferring an image, as well. That is, one driving motor drives the rotation of various rollers.

Accordingly, when the output shaft of the driving motor is rotated backward, various rollers also rotate backward, which causes various problems.

As disclosed in the aforementioned JP 2003-280308A, if some one-way clutches are mounted in the gear unit, it is possible to avoid the backward rotation of various rollers and the like even when the output shaft of the driving motor is rotated backward. However, since one-way clutches are mounted in the gear unit itself, the configuration of the gear unit becomes complex.

SUMMARY OF THE INVENTION

The present invention provides a fixing apparatus capable of switching and performing rotational driving of a pressure roller and a hot roller and an operation to bring the pressure roller into and out of contact with the hot roller, without rotating a driving motor backward or without making the configuration of a gear unit disposed in the vicinity of the fixing apparatus complex.

The fixing apparatus of the present invention is a fixing apparatus including a first roller and a second roller, a biasing portion (biasing means) that presses the first roller and the second roller against each other, and a driving portion (driving means) that rotates the first roller and the second roller, and that sandwiches a recording material in a nip region between the first roller and the second roller and transports the recording material. The fixing apparatus includes a swing cam that rotates in one direction by a rotational driving force provided by the driving portion being transmitted thereto, a displacement support member that axially supports the second roller and displaces the second roller so that the second roller is brought into and out of contact with the first roller, a pressure release cam that slidingly contacts the displacement support member, a one-way clutch that is provided to a shaft of the pressure release cam, and a swing lever that is connected to the one-way clutch and is biased so as to slidingly contact the swing cam. When the swing cam is rotated in one direction due to the rotational driving force provided by the driving portion, the swing lever that slidingly contacts the swing cam repeatedly swings, swinging the swing lever is transmitted via the one-way clutch to the pressure release cam as intermittent rotation in one direction, the pressure release cam pushes away the displacement support member, opposing a biasing force applied by the biasing portion, the displacement support member and the second roller are displaced, and the second roller is separated from the first roller.

Also, the fixing apparatus may further include a control portion (control means) that is connected to the swing lever and moves the swing lever so that the swing lever separates from the swing cam.

Moreover, the fixing apparatus may further include a reverse rotation blocking portion (reverse rotation blocking means) that blocks rotation of the shaft of the pressure release cam in an idling direction due to the rotation of the one-way clutch in the idling direction.

According to such a fixing apparatus of the present invention, when the swing cam is rotated in one direction due to the rotational driving force provided by the driving portion, the swing lever that slidingly contacts the swing cam repeatedly swings, swinging the swing lever is transmitted via the one-way clutch to the pressure release cam as intermittent rotation in one direction, the pressure release cam pushes away the displacement support member, opposing a biasing force applied by the biasing portion, the displacement support member and the second roller are displaced, and the second roller is separated from the first roller.

Here, since the swing lever repeatedly swings irrespective of the rotational direction of the swing cam, it is not necessary to specify the direction in which the swing cam is rotated by the driving portion. Also, it is not necessary to switch the rotational driving direction of the driving portion that rotates the first and second rollers. Accordingly, it is not necessary to switch the rotational direction of an output shaft of the driving motor or to mount a one-way clutch in the driving portion itself that rotates the first and second rollers, either.

Further, since the rotational driving force provided by the driving portion is transmitted via the swing lever and the one-way clutch to the pressure release cam, it is not necessary to particularly change the configuration of the driving portion itself (a gear unit, etc.); thus, the gear unit will not be complex.

Note that after the second roller has separated from the first roller, when a position of the displacement support member that slidingly contacts the pressure release cam is returned to the original position, by re-starting the rotation of the swing cam in one direction, swinging the swing lever, and intermittently rotating the pressure release cam, the second roller is pressed against the first roller.

Moreover, since the fixing apparatus includes a control portion that moves the swing lever so that the swing lever separates from the swing cam, the swing lever can be stopped from swinging. Further, the pressure release cam can be stopped from rotating, and the displacement support member and the second roller can also be stopped from being displaced. Moreover, at this time, without performing an operation to bring the second roller into and out of contact with the first roller, the driving portion can rotate the first and second rollers. Therefore, rotational driving of the first and second rollers and an operation to bring the second roller into and out of contact with the first roller can be switched and performed.

Furthermore, since the fixing apparatus includes a reverse rotation blocking portion that blocks rotation of the shaft of the pressure release cam in an idling direction due to the rotation of the one-way clutch in the idling direction, after the one-way clutch rotates in the rotation-transmitting direction so that the shaft of the pressure release cam rotates in one direction, even when the one-way clutch rotates in the idling direction, the shaft of the pressure release cam will not rotate in reverse by rotating in the idling direction, and the shaft of the pressure release cam reliably and intermittently rotates in one direction.

DESCRIPTION OF THE PREFERRED EMBODIMENTS

Hereinafter, an embodiment of the present invention will be described in detail with reference to the accompanying drawings.

Figure 1:
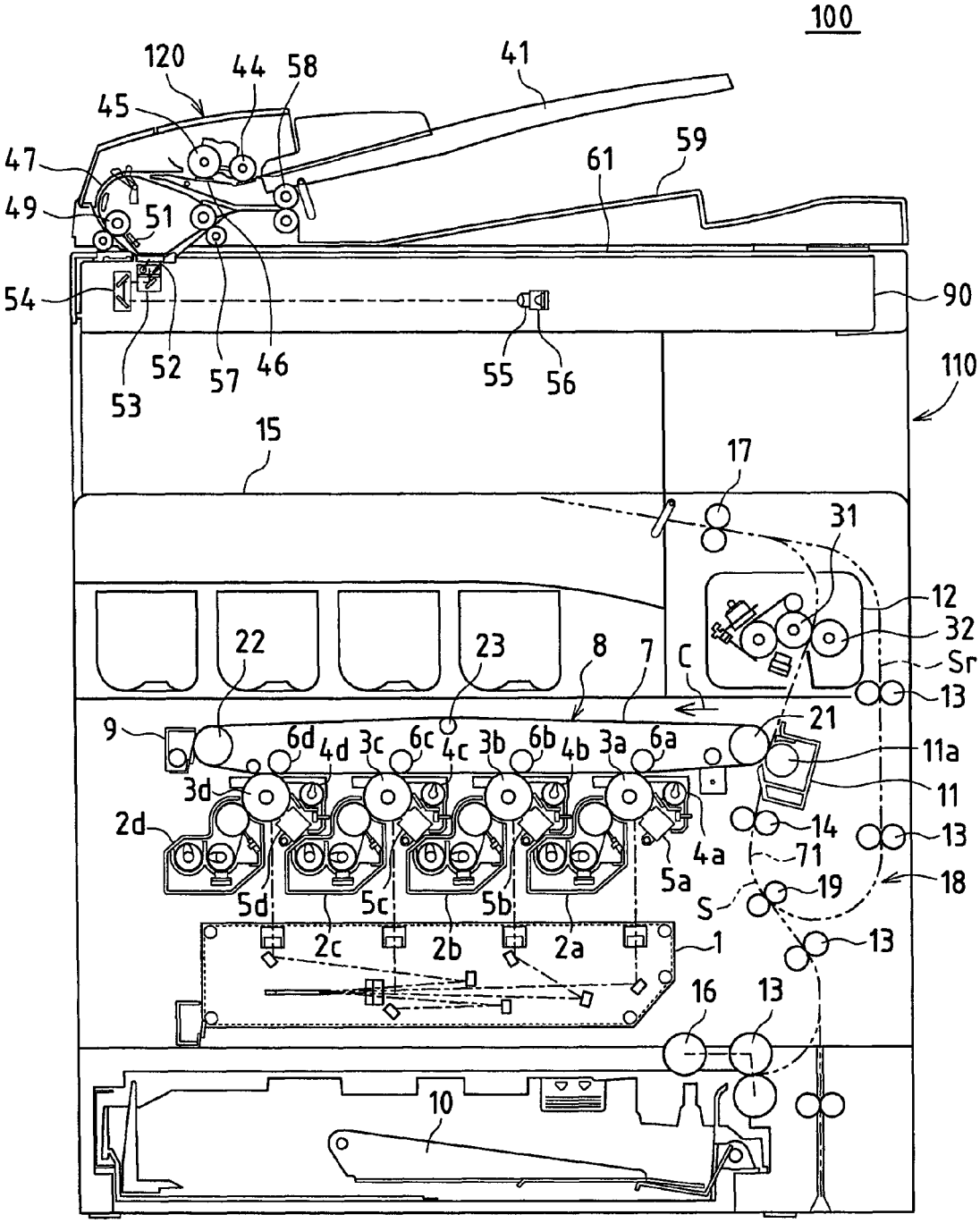
FIG. 1 is a cross-sectional view showing an image forming apparatus to which an embodiment of a fixing apparatus of the present invention has been applied.

FIG. 1 is a cross-sectional view showing an image forming apparatus 100, which an embodiment of a fixing apparatus of the present invention has been applied to. The image forming apparatus 100 includes an original reading apparatus 120, which reads an original image, and an apparatus main body 110, which records and forms, on recording paper in color or in a single color, an original image read by the original reading apparatus 120 or an image received from outside.

In the original reading apparatus 120, when originals are set on an original setting tray 41, a pickup roller 44 is pressed against the surface of the originals and rotated. Then, the originals are drawn out from the original setting tray 41 and passed between a separation roller 45 and a separation pad 46 so as to be individually separated. Thereafter, the originals are transported to a transport path 47.

In the transport path 47, a leading edge of an original abuts against registration rollers 49 so as to be aligned parallel to the registration rollers 49. Thereafter, the original is transported by the registration rollers 49 and passes between a reading guide 51 and a reading glass 52. At this time, light from a light source of a first scanning unit 53 is irradiated onto the surface of an original via the reading glass 52, and the reflected light is made to fall incident to the first scanning unit 53 via the reading glass 52. Then, the reflected light is reflected on mirrors of the first scanning unit 53 and a second scanning unit 54 and led to an imaging lens 55. An original image is formed on a CCD (Charge Coupled Device) 56 by the imaging lens 55. The CCD 56 reads the original image and outputs image data indicating the original image. Further, the original is transported by transport rollers 57 and discharged onto a discharge tray 59 via discharge rollers 58.

Also, an original placed on an original stage glass 61 can be read. The registration rollers 49, the reading guide 51, the discharge tray 59, and the like are integrated with members disposed above these elements, thus forming a cover body that is pivotally mounted in an openable and closable manner on a back side of the original reading apparatus 120. When this cover body provided in the upper part is opened, the original stage glass 61 is released, and an original can be placed on the original stage glass 61. When an original is placed thereon and the cover body is closed, with the first scanning unit 53 and the second scanning unit 54 being moved in the sub scanning direction, the first scanning unit 53 exposes the surface of the original on the original stage glass 61, the first scanning unit 53 and the second scanning unit 54 lead light reflected on the surface of the original to the imaging lens 55, and the original image is formed on the CCD 56 by the imaging lens 55. At this time, the first scanning unit 53 and the second scanning unit 54 are moved while maintaining a predetermined speed relationship therebetween. Also, the positional relationship between the first scanning unit 53 and the second scanning unit 54 is always maintained in order not to change the length of the optical path of the reflected light (the surface of an original→the first scanning unit 53 and the second scanning unit 54→the imaging lens 55→the CCD 56. Consequently, a state in which an original image on the CCD 56 is accurately focused on is always maintained).

The entire original image read thereby is transmitted to the apparatus main body 110 of the image forming apparatus 100 as image data, and the image is recorded onto recording paper in the apparatus main body 110.

Meanwhile, the apparatus main body 110 of the image forming apparatus 100 is configured of a laser exposing apparatus 1, development apparatuses 2, photosensitive drums 3, charging units 5, cleaner apparatuses 4, an intermediate transfer belt apparatus 8, a fixing apparatus 12, a paper transport apparatus 18, a paper feed tray 10, a discharge tray 15, and the like.

Image data handled in the image forming apparatus 100 corresponds to a color image using black (K), cyan (C), magenta (M), and yellow (Y), or corresponds to a monochrome image using a single color (for example, black). Accordingly, four units of each of the development apparatuses 2 (2*a*, 2*b*, 2*c*, and 2*d*), the photosensitive drums 3 (3*a*, 3*b*, 3*c*, and 3*d*), the charging units 5 (5*a*, 5*b*, 5*c*, and 5*d*), and the cleaner apparatuses 4 (4*a*, 4*b*, 4*c*, and 4*d*) are provided in order to form four types of latent images corresponding to each color. With each a corresponding to black, each b corresponding to cyan, each c corresponding to magenta, and each d corresponding to yellow, four image stations are configured.

The photosensitive drums 3 are disposed substantially in the center of the apparatus main body 110.

The charging unit 5 is a charging means for uniformly charging the surface of the photosensitive drum 3 at a predetermined electric potential. Other than a contact-roller-type charging unit or a contact-brush-type charging unit, a charging-type charging unit is used as the charging unit 5.

The laser exposing apparatus 1 is a laser scanning unit (LSU) including a laser diode and a reflection mirror, and exposes the surface of the charged photosensitive drum 3 in accordance with image data, and forms an electrostatic latent image on the surface thereof in accordance with the image data.

The development apparatuses 2 develop electrostatic latent images formed on the photosensitive drums 3 using a toner (K, C, M, and Y). The cleaner apparatuses 4 remove and collect residual toner on the surfaces of the photosensitive drums 3 after developing and transferring images.

The intermediate transfer belt apparatus 8 disposed above the photosensitive drums 3 includes an intermediate transfer belt 7, an intermediate transfer belt drive roller 21, an idler roller 22, intermediate transfer rollers 6 (6*a*, 6*b*, 6*c*, and 6*d*), and an intermediate transfer belt cleaning apparatus 9.

The intermediate transfer belt 7 is stretched across and supported by the intermediate transfer belt drive roller 21, the intermediate transfer rollers 6, the idler roller 22, and the like, which allow the intermediate transfer belt 7 to move around in the direction of arrow C.

The intermediate transfer rollers 6 are rotatably supported near the intermediate transfer belt 7, and pressed against the photosensitive drums 3 via the intermediate transfer belt 7. A transfer bias for transferring toner images on the photosensitive drums 3 onto the intermediate transfer belt 7 is applied to the intermediate transfer rollers 6.

The intermediate transfer belt 7 is provided so as to be in contact with the photosensitive drums 3*a*, 3*b*, 3*c*, and 3*d*. A toner image on the surfaces of the photosensitive drums 3*a*, 3*b*, 3*c*, and 3*d* is sequentially superimposed and transferred onto the intermediate transfer belt 7 so as to form a color toner image (toner images of each color). This transfer belt is formed so as to be endless belt-shaped, using a film having a thickness of approximately 100 μm to 150 μm.

A toner image is transferred from the photosensitive drums 3 to the intermediate transfer belt 7 by the intermediate transfer rollers 6, which are pressed against the inner face of the intermediate transfer belt 7. In order to transfer the toner images, a high voltage transfer bias (high voltage with the opposite polarity (+) to the charge polarity (−) of the toner) is applied to the intermediate transfer rollers 6. The intermediate transfer rollers 6 use a metal (stainless steel, for example) shaft with a diameter of 8 to 10 mm as a base, and the surface thereof is covered with conductive elastic material (such as EPDM or urethane foam, for example). With this conductive elastic material, it is possible to uniformly apply a high voltage to recording paper.

The toner images on the surfaces of the photosensitive drums 3*a*, 3*b*, 3*c*, and 3*d* are laminated on the intermediate transfer belt 7 as described above and become a color toner image indicated by image data. The toner images of each color laminated as described above are transported together with the intermediate transfer belt 7 and transferred onto the recording paper by a secondary transfer apparatus 11, which is in contact with the intermediate transfer belt 7.

The intermediate transfer belt 7 and a transfer roller 11*a* of the secondary transfer apparatus 11 are pressed against each other so as to form a nip region. Further, a voltage (high voltage with the opposite polarity (+) to the charge polarity (−) of the toner) for transferring toner images of each color on the intermediate transfer belt 7 onto recording paper is applied to the transfer roller 11*a* of the secondary transfer apparatus 11. Furthermore, in order to obtain the nip region constantly, either one of the transfer roller 11*a* of the secondary transfer apparatus 11 or the intermediate transfer belt drive roller 21 is made of a hard material (metal or the like), and the other is a roller made of a soft material, such as an elastic roller (elastic rubber roller, foam resin roller, or the like).

There is a case in which the secondary transfer apparatus 11 does not completely transfer a toner image on the intermediate transfer belt 7 onto recording paper, thus leaving toner on the intermediate transfer belt 7, so that the residual toner causes color toners to be mixed in the following processing. For this reason, the intermediate transfer belt cleaning apparatus 9 removes and collects residual toner. The intermediate transfer belt cleaning apparatus 9 includes, for example, a cleaning blade as a cleaning member that is in contact with the intermediate transfer belt 7, and the intermediate transfer belt 7 is supported by the idler roller 22 from the inner face in a position where the cleaning blade is in contact with the intermediate transfer belt 7.

The paper feed tray 10 is a tray for storing recording paper and is provided in the lower part of an image forming portion of the apparatus main body 110. Also, the discharge tray 15 provided in the upper part of the image forming portion is a tray on which printed recording paper is to be placed face-down.

Further, the apparatus main body 110 is provided with the paper transport apparatus 18 for conveying recording paper on the paper feed tray 10 to the discharge tray 15 through the secondary transfer apparatus 11 and the fixing apparatus 12. The paper transport apparatus 18 has an S-shaped paper transport path S, and a pickup roller 16, registration rollers 14, the fixing apparatus 12, transport rollers 13, discharge rollers 17, and the like are disposed along the paper transport path S.

The pickup roller 16 is a draw-in roller that is provided on the edge portion of the paper feed tray 10 and that supplies pieces of recording paper one-by-one from the paper feed tray 10 to the paper transport path S. The transport rollers 13 are small rollers for promoting and helping transportation of recording paper, and are provided in a plurality of positions along the paper transport path S.

The registration rollers 14 temporarily stop transported recording paper, align the leading edge of the recording paper, and then transport the recording paper with good timing matched with the rotation of the photosensitive drums 3 and the intermediate transfer belt 7 so that a color toner image on the intermediate transfer belt 7 is transferred onto the recording paper in the nip region between the intermediate transfer belt 7 and the secondary transfer apparatus 11.

The fixing apparatus 12 receives recording paper on which a toner image has been transferred, sandwiches the recording paper in a nip region between a hot roller 31 and a pressure roller 32, and transports the recording paper.

The recording paper on which toner images of each color have been fixed is discharged by the discharge rollers 17 onto the discharge tray 15.

Note that it is also possible to form a monochrome image using only an image forming station Pa and transfer the monochrome image onto the intermediate transfer belt 7 of the intermediate transfer belt apparatus 8. The monochrome image is transferred onto recording paper from the intermediate transfer belt 7 and fixed onto the recording paper, similarly to a color image.

Further, when printing not only the front face of the recording paper, but both faces, after an image on the front face of the recording paper has been fixed by the fixing apparatus 12, the discharge rollers 17 are stopped and then rotated in reverse while transporting the recording paper by the discharge rollers 17 on the paper transport path S, thereby causing the recording paper to pass through a reverse path Sr. After the front and back of the recording paper are reversed, the recording paper is led to the registration rollers 14. Similarly to the case of printing the front face of the recording paper, an image is recorded and fixed on the back face of the recording paper, and the recording paper is discharged onto the discharge tray 15.

Figure 2:
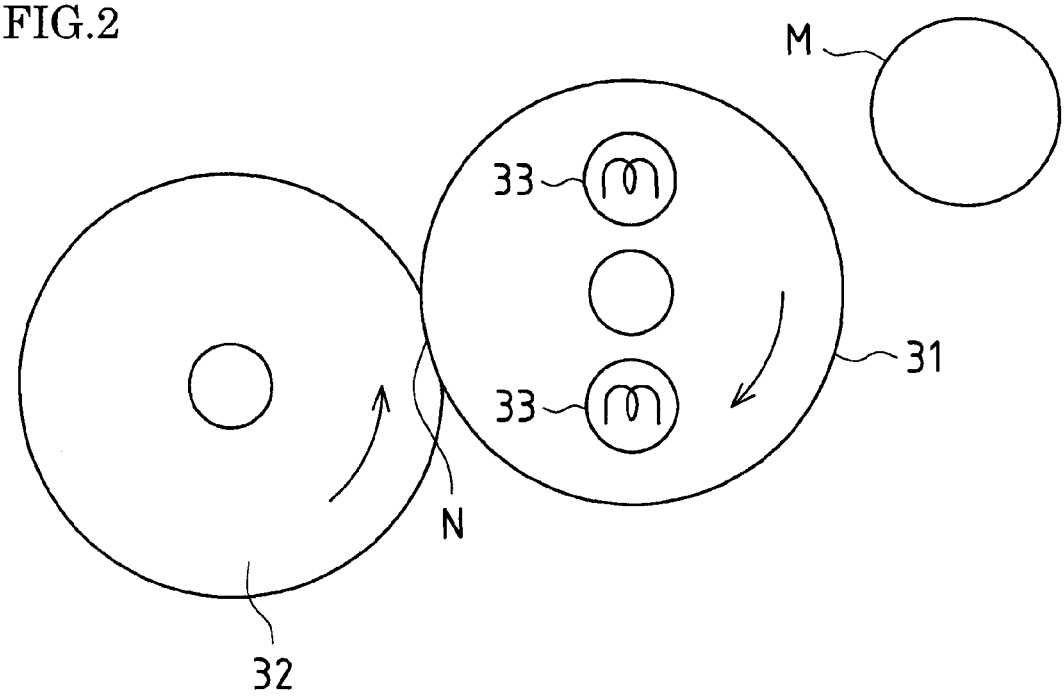
FIG. 2 is a side view showing a schematic configuration of the fixing apparatus of the embodiment.

In the fixing apparatus 12 of the present embodiment, as shown in FIG. 2, the hot roller 31 and the pressure roller 32 are pressed against each other and respectively axially supported so as to form a nip region N, in which recording paper is sandwiched between the hot roller 31 and the pressure roller 32. The hot roller 31 is driven to rotate in the direction of the arrow by a driving motor M, with the pressure roller 32 being idly rotated. Recording paper passes through the nip region N so as to be heated and pressed. Thereby, a toner image on the recording paper is melted, mixed, and pressed so as to be thermally fixed onto the recording paper. Note that a rotational driving force transmitting mechanism between the hot roller 31 and the driving motor M is omitted in FIG. 2.

The hot roller 31 is a roller having a three-layer structure in which an elastic layer is provided on an outer surface of a core metal and a mold release layer is formed on an outer surface of the elastic layer. For example, a metal such as iron, stainless steel, aluminum, or copper, or an alloy of these, is used for the core metal. Furthermore, a silicon rubber is used for the elastic layer, and a fluorocarbon resin such as PFA (tetrafluoroethylene-perfluoroalkylvinylether copolymer) or PTFE (polytetrafluoroethylene) is used for the mold release layer.

Heater lamps (halogen lamps) 33, which are heat sources for heating the hot roller 31, are provided inside the hot roller 31 (inside the core metal).

Similar to the hot roller 31, the pressure roller 32 is a roller that also has a three-layer structure in which a core metal made of a metal such as iron, stainless steel, aluminum, or copper, or an alloy of these, an elastic layer made of a silicon rubber or the like on the surface of the core metal, and further still a mold release layer made of PFA, PTFE, or the like on the elastic layer are provided.

Here, in order to retain the width of the nip region between the hot roller 31 and the pressure roller 32, a large pressure between the hot roller 31 and the pressure roller 32 is set. Thus, when the fixing apparatus 12 is not used, and the hot roller 31 and the pressure roller 32 are in a stopped state for a long time, the elastic layers of the hot roller 31 and the pressure roller 32 are kept deformed, so that the shapes of the layers may not return to the original shapes thereof and depressions may be formed in the elastic layers of the hot roller 31 and the pressure roller 32.

In view of this, in the fixing apparatus 12 of the present embodiment, when the hot roller 31 and the pressure roller 32 are stopped, the hot roller 31 and the pressure roller 32 are separated in order to prevent the elastic layers of the hot roller 31 and the pressure roller 32 from being left deformed.

Figure 3:
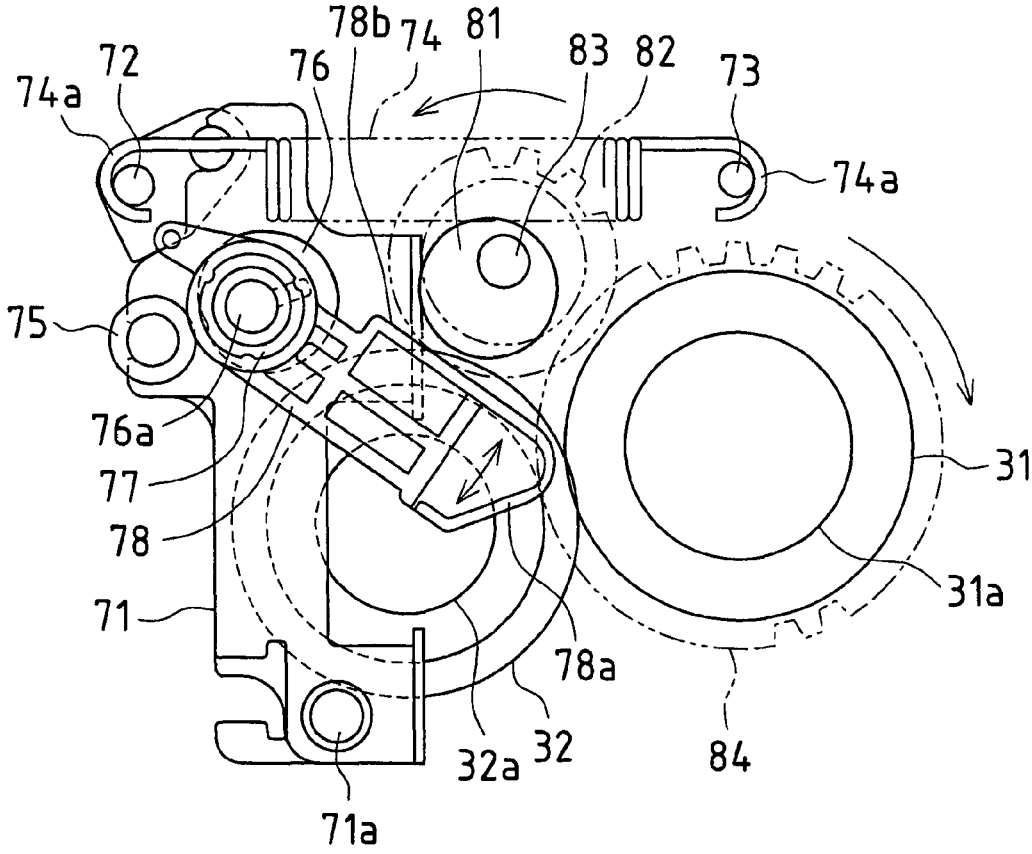
FIG. 3 is a cross-sectional view showing a configuration of one end side of the rollers in the fixing apparatus of the embodiment.
Figure 4:
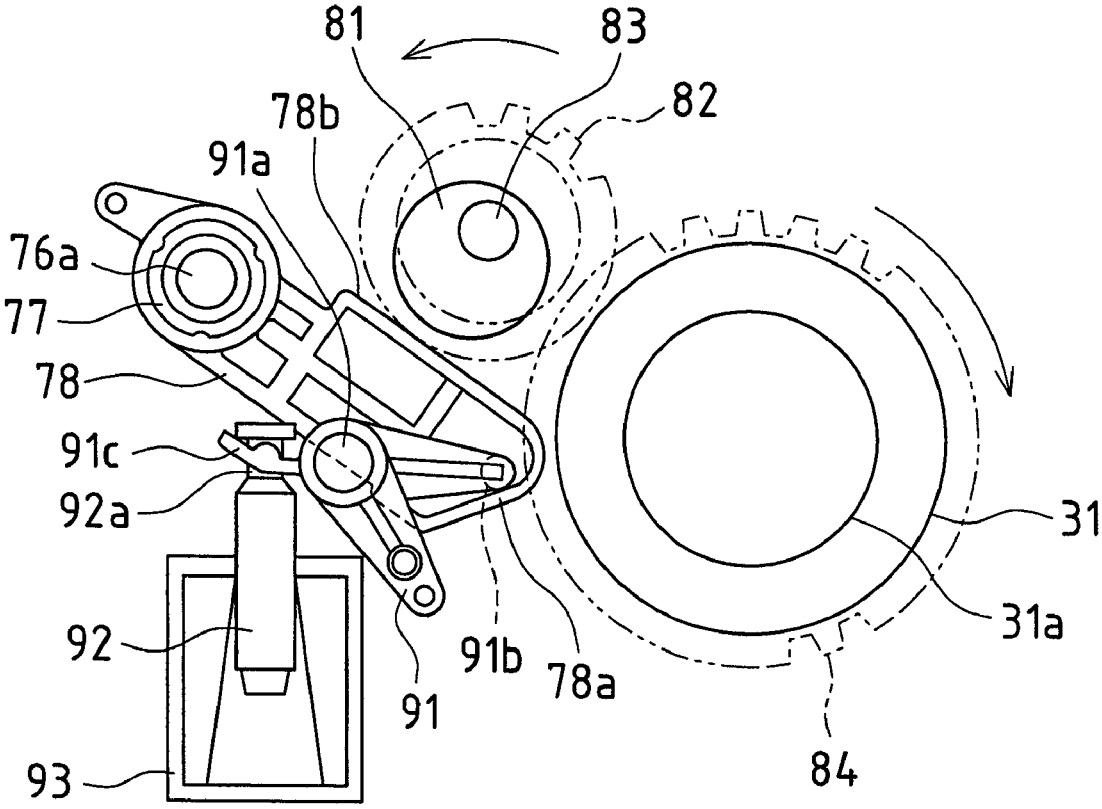
FIG. 4 is a cross-sectional view showing a configuration of one end side of the rollers in the fixing apparatus of the embodiment and shows a cross section at a position further towards the outside than that of the cross section as shown in FIG. 3.

FIGS. 3 and 4 are cross-sectional views showing configurations of one end side of the hot roller 31 and the pressure roller 32 in the fixing apparatus 12. The views shown in FIGS. 3 and 4 are sectioned at different positions, and the configuration shown in FIG. 4 is positioned further towards the outside than the configuration shown in FIG. 3.

First, in FIG. 3, a shaft 31*a* of the hot roller 31 is axially supported on a body frame (not shown) of the fixing apparatus 12, and the position where the shaft is axially supported is fixed. Also, a shaft 32*a* of the pressure roller 32 is axially supported on a displacement frame 71. The displacement frame 71 has a shaft 71*a* supported on the body frame of the fixing apparatus 12 and can rotate around the shaft 71*a*. Hooks 74*a* on both ends of a coil spring 74 are respectively hooked around a pin 72 on the left upper end of the displacement frame 71 and a pin 73 on the body frame, and the pin 72 on the displacement frame 71 is pulled by the coil spring 74 toward the body frame side. The displacement frame 71 is biased clockwise with the shaft 71*a* as the center, and the pressure roller 32 is pressed against the hot roller 31.

A roller 75 is provided on the left end of the displacement frame 71. Further, a shaft 76*a* is axially supported on the body frame of the fixing apparatus 12 and protrudes through an opening portion (not shown) of the displacement frame 71 disposed further towards the outside than the body frame. A pressure release cam (eccentric cam) 76 is fixed on the shaft 76*a* in a position where the shaft 76*a* protrudes. As described above, the displacement frame 71 is pulled toward the body frame side by the coil spring 74 so that the roller 75 is pressed against the pressure release cam 76.

A one-way clutch 77 is provided to the shaft 76*a* of the pressure release cam 76. The one-way clutch 77 is provided further towards the outside than the pressure release cam 76 and parallel thereto, and a swing lever 78 is fixedly connected to the one-way clutch 77. The one-way clutch 77 is interposed between the swing lever 78 and the shaft 76*a* of the pressure release cam 76. Only the clockwise rotation of the swing lever 78 is transmitted to the shaft 76*a* of the pressure release cam 76 via the one-way clutch 77. When the swing lever 78 rotates counterclockwise, the one-way clutch 77 idles, and the counterclockwise rotation is not transmitted to the shaft 76*a* of the pressure release cam 76.

The swing lever 78 is biased counterclockwise by a spring (not shown) with the shaft 76*a* of the pressure release cam 76 as the center.

A shaft 83, which is common to a swing cam (eccentric cam) 81 and a swing gear 82, is axially supported on the body frame of the fixing apparatus 12. The swing gear 82 meshes with a drive gear 84 fixed on the shaft 31*a* of the hot roller 31. Accordingly, when the hot roller 31 is driven to rotate, the drive gear 84 rotates so that the swing gear 82 and the swing cam 81 rotate.

In FIG. 4, a doglegged control lever 91 is axially and rotatably supported by a shaft 91*a* fixed on the body frame of the fixing apparatus 12. A pin 91*b* is provided on the back side of one end of the control lever 91 in a protruding manner facing inward, and the pin 91*b* is inserted in a frame portion 78*a* on the right side of the swing lever 78. The frame portion 78*a* is edged with a rib, so that the pin 91*b* on the back side of one end of the control lever 91 catches the rib.

A pair of clamping portions 91*c* are provided in a protruding manner in the center of the control lever 91. When the tip of a plunger 92 is viewed from above, a constricted portion 92*a* of the plunger 92 is sandwiched between these clamping portions 91*c*. The plunger 92 is inserted in an opening formed in the center of a solenoid 93. When the solenoid 93 is in a de-energized state, the plunger 92 is biased upward by a spring (not shown) so as to protrude from the solenoid 93. On the other hand, when the solenoid 93 is in an energized state, the plunger 92 is pulled inside the solenoid 93.

In FIG. 4, the solenoid 93 is de-energized so that the plunger 92 protrudes from the solenoid 93. Accordingly, the clamping portions 91*c* of the control lever 91 clamping the constricted portion 92*a* of the plunger 92 are pushed up, and the control lever 91 rotates clockwise with the shaft 91*a* as the center. Thus, the pin 91*b* on the back side of one end of the control lever 91 moves downward. At this time, the pin 91*b* catches the rib of the frame portion 78*a* on the right side of the swing lever 78 so as to push down the right side of the swing lever 78. Opposing a counterclockwise biasing force applied by a spring (not shown) of the swing lever 78, the pin 91*b* rotates the swing lever 78 clockwise. As a result of this, a sliding contact edge 78*b* on the right side of the swing lever 78 is separated from the circumferential face of the swing cam 81.

As described above, in a state in which the sliding contact edge 78*b* on the right side of the swing lever 78 is separated from the circumferential face of the swing cam 81, even when the hot roller 31 of the fixing apparatus 12 is driven to rotate so that the drive gear 84 rotates and the swing gear 82 and the swing cam 81 rotate, the state in which the swing lever 78 is stopped is maintained.

Figure 5:
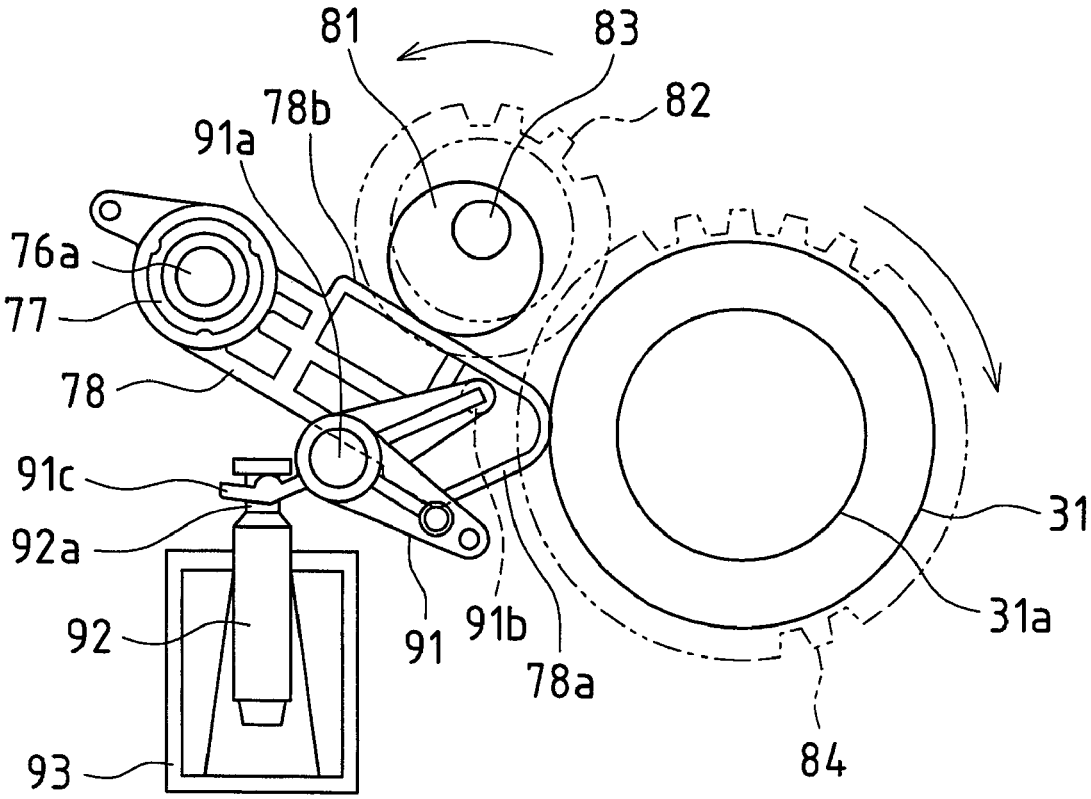
FIG. 5 is a diagram showing an operation of a control lever shown in FIG. 4.

On the other hand, as shown in FIG. 5, when the solenoid 93 is energized so that the plunger 92 is pulled inside the solenoid 93, the clamping portions 91*c* of the control lever 91 clamping the constricted portion 92*a* of the plunger 92 are pulled down. Accordingly, the control lever 91 rotates counterclockwise with the shaft 91*a* as the center, and the pin 91*b* on the back side of one end of the control lever 91 goes up. As a result of this, the swing lever 78 can rotate clockwise or counterclockwise in a range where the pin 91*b* bumps against the inner circumference of the rib of the frame portion 78*a* on the right side of the swing lever 78.

At this time, due to a biasing force applied by a spring (not shown), the swing lever 78 rotates counterclockwise with the shaft 76*a* of the pressure release cam 76 as the center, and the sliding contact edge 78*b* on the right side of the swing lever 78 abuts against the circumferential face of the swing cam 81.

In this state, when the hot roller 31 is driven to rotate and the drive gear 84 rotates so that the swing gear 82 and the swing cam 81 rotate, the sliding contact edge 78*b* on the right side of the swing lever 78 follows the circumferential face of the swing cam 81 so as to move up and down, and the swing lever 78 swings.

Figure 6:
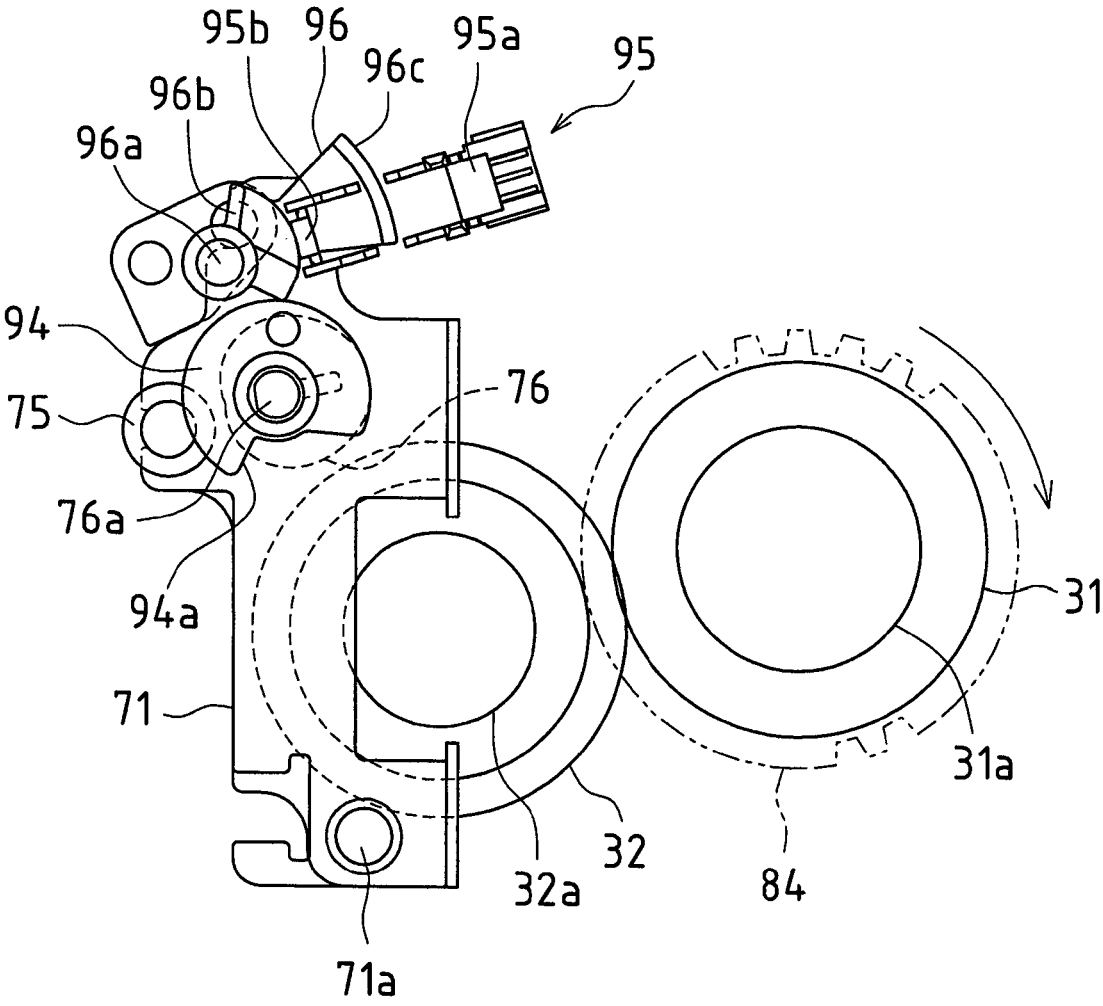
FIG. 6 is a cross-sectional view showing a configuration of one end side of the rollers in the fixing apparatus of the embodiment and shows a cross section at a position further towards the outside than that of the cross section as shown in FIG. 4.

Furthermore, as shown in FIG. 6, a cam 94 is provided to the shaft 76*a* of the pressure release cam 76, and the cam 94 is provided further towards the outside than the one-way clutch 77 and the swing lever 78, and parallel thereto. The cam 94 rotates together with the pressure release cam 76 and the shaft 76*a* thereof, and a pressure control sensor 95 detects the rotation.

The pressure control sensor 95 has a detection member 96, which is displaced in accordance with the rotation of the cam 94, and detects the displacement of the detection member 96.

Figure 7:
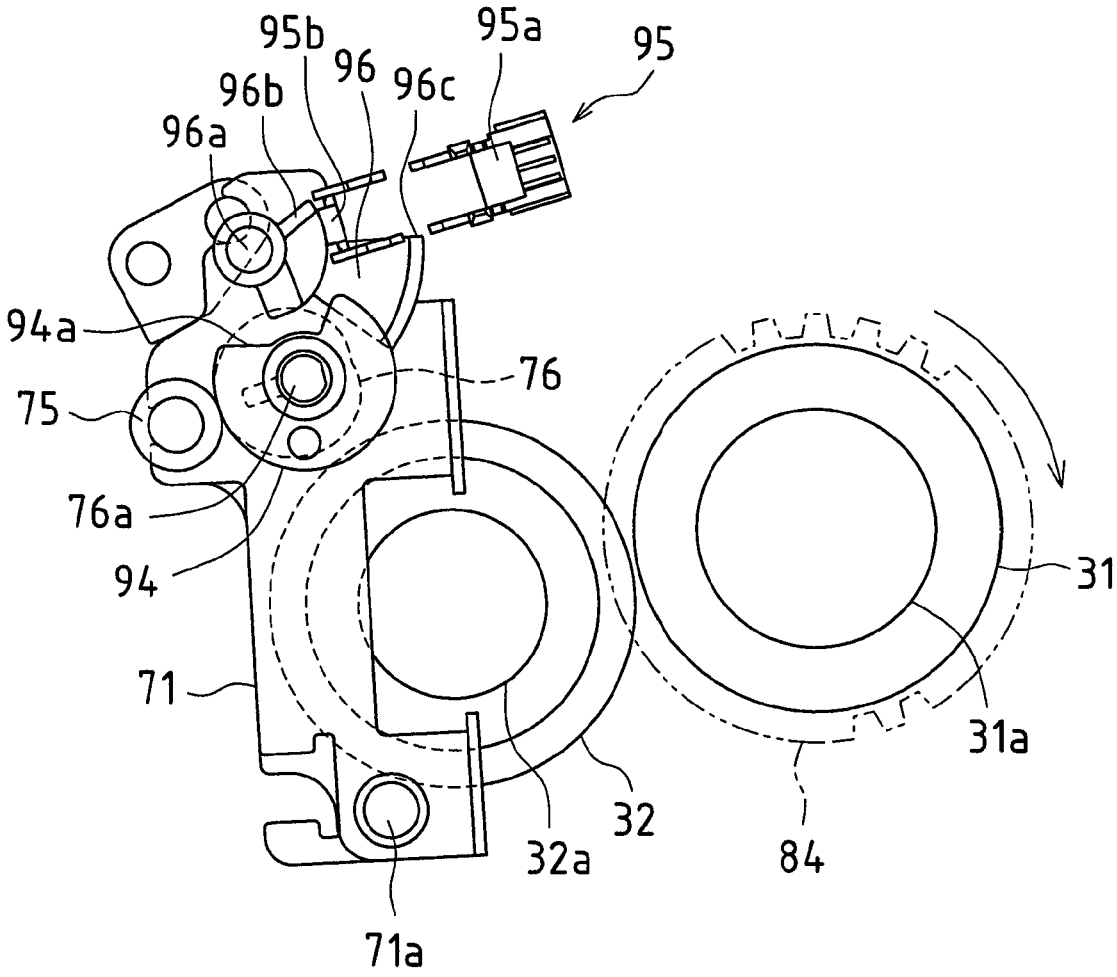
FIG. 7 is a diagram showing an operation of a cam shown in FIG. 6.

The cam 94 is a disk, part of which is formed of a notch portion 94*a*. Further, the detection member 96 of the pressure control sensor 95 is axially and rotatably supported by a shaft 96*a* and has a fan-shaped sliding contact portion 96*b* with the shaft 96*a* as the center and an arc wall portion 96*c* with the shaft 96*a* as the center. As shown in FIG. 6, when the circumferential face on the short diameter side of the pressure release cam 76 faces the roller 75, the notch portion 94*a* of the cam 94 faces downward, so that the circumferential face of the cam 94 pushes up the sliding contact portion 96*b* of the detection member 96. Accordingly, the arc wall portion 96*c* of the detection member 96 moves up to and between a light emitting element 95*a* and a light receiving element 95*b* of the pressure control sensor 95, thereby blocking the space between the light emitting element 95*a* and the light receiving element 95*b*. Also, as shown in FIG. 7, when the circumferential face on the long diameter side of the pressure release cam 76 is pressed against the roller 75, the cam 94 rotates 180 degrees around so that the notch portion 94*a* of the cam 94 faces upward. Accordingly, the sliding contact portion 96*b* of the detection member 96 moves into the notch portion 94*a*, and the detection member 96 rotates around the shaft 96*a*. Thus, the arc wall portion 96*c* of the detection member 96 is brought out of the space between the light emitting element 95*a* and the light receiving element 95*b*, thus releasing the space between the light emitting element 95*a* and the light receiving element 95*b*. Therefore, based on the light receiving output from the light receiving element 95*b*, the rotation of the cam 94 and the pressure release cam 76 can be detected.

Figure 8:
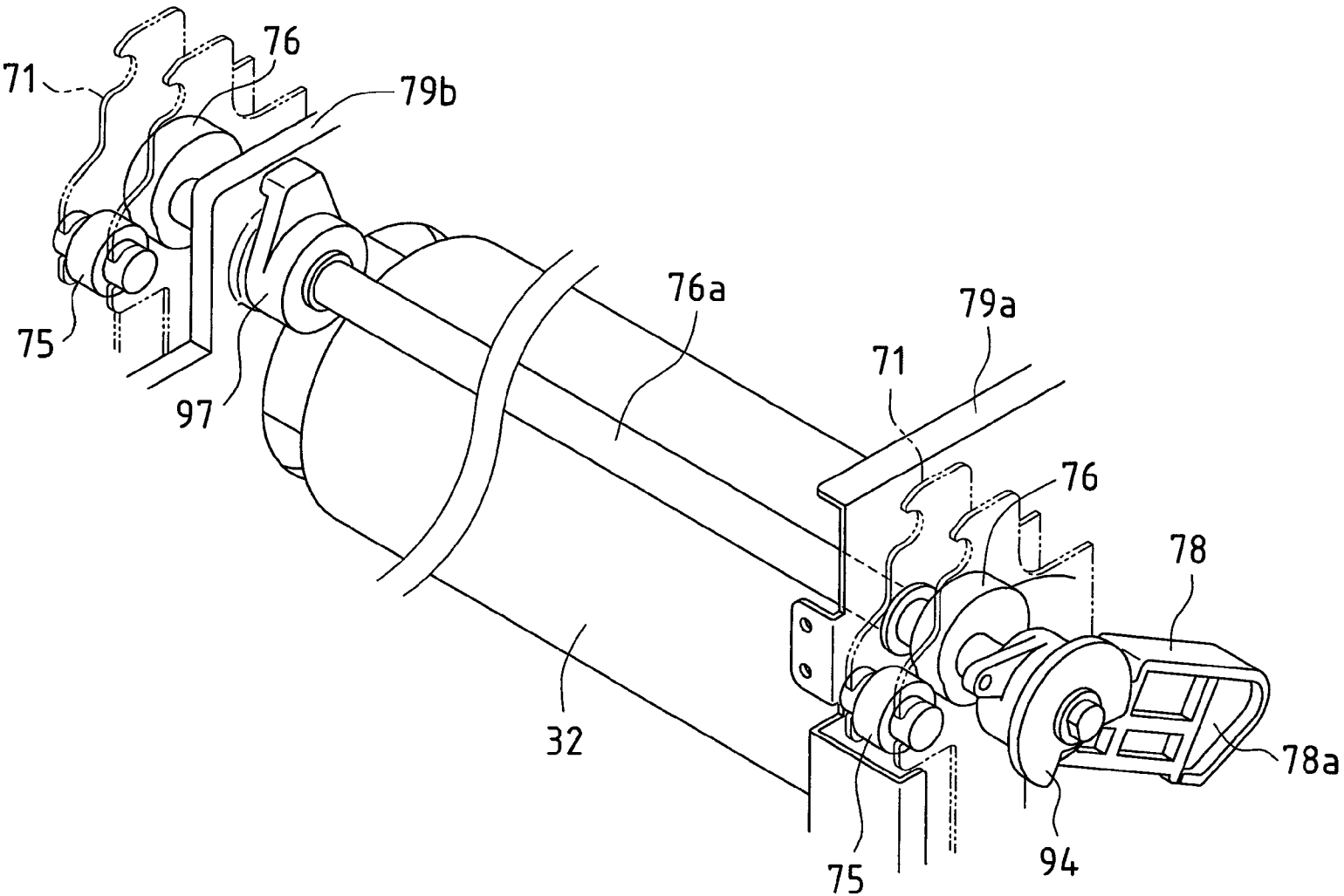
FIG. 8 is a perspective view schematically showing a configuration of both ends of the rollers in the fixing apparatus of the embodiment.

As shown in FIG. 8, body frames 79*a* and 79*b* are disposed on both ends of the pressure roller 32, and both ends of the shaft 31*a* of the hot roller 31 (shown in FIG. 3) are axially supported on these body frames 79*a* and 79*b*. Also, the displacement frame 71 is disposed further towards the outside than the body frame 79*a* on one end, and the displacement frame 71 is disposed further towards the outside than the body frame 79*b* on the other end as well. Further, both ends of the shaft 32*a* of the pressure roller 32 protrude outside the body frames 79*a* and 79*b* so as to be axially supported on the respective displacement frames 71. The displacement frames 71 are respectively biased by a coil spring 74 (as shown in FIG. 3) so that the pressure roller 32 is pressed against the hot roller 31.

Also, the pressure release cam 76 and the roller 75 that presses against the pressure release cam 76 are provided on the side where the body frame 79*b* and the displacement frame 71 close thereto are provided. The shaft 76*a* for the pressure release cams 76 on both sides is one common shaft, and if the shaft 76*a* is rotated on the body frame 79*a* side, the pressure release cams 76 on both sides rotate.

Moreover, a one-way clutch 97 for blocking reverse rotation is fixed inside the body frame 79*b*. and the shaft 76*a* of the pressure release cam 76 is passed through the one-way clutch 97 to block reverse rotation. The one-way clutch 97 for blocking reverse rotation idles when the one-way clutch 77 on the body frame 79*a* side transmits clockwise rotation to the shaft 76*a*, enabling the shaft 76*a* to rotate clockwise. When the shaft 76*a* would rotate due to the influence of the counterclockwise idling of the one-way clutch 77 on the body frame 79*a* side, the one-way clutch 97 prohibits the shaft 76*a* from rotating counterclockwise. Thus, the one-way clutch 77 on the body frame 79*a* side and the one-way clutch 97 for blocking reverse rotation provided inside the body frame 79*b* transmit rotation and idle, in opposite directions.

When the fixing apparatus 12 as described above performs a fixing operation, as shown in FIG. 4, the solenoid 93 is de-energized so that the plunger 92 protrudes from the solenoid 93. Consequently, the plunger 92 pushes up the clamping portions 91*c* of the control lever 91, and the pin 91*b* on the back side of one end of the control lever 91 moves downward. Thus, the swing lever 78 is rotated clockwise due to the pin 91*b*, and the sliding contact edge 78*b* on the right side of the swing lever 78 is separated from the circumferential face of the swing cam 81.

Also, as shown in FIG. 3, the circumferential face on the short diameter side of the pressure release cam 76 faces the roller 75 of the displacement frame 71, and the pressure roller 32 is pressed against the hot roller 31.

In this state, the hot roller 31 of the fixing apparatus 12 is driven to rotate, so that the pressure roller 32 idly rotates. Then, recording paper passes through the nip region N between the hot roller 31 and the pressure roller 32 so as to be heated and pressed.

At this time, although the drive gear 84 rotates together with the hot roller 31 so that the swing gear 82 and the swing cam 81 rotate, since the swing lever 78 is separated from the circumferential face of the swing cam 81, the state in which the swing lever 78 is stopped is maintained. Accordingly, an operation to bring the pressure roller 32 into and out of contact with the hot roller 31 (described later) will not be performed.

Therefore, when the hot roller 31 is driven to rotate in a state in which the solenoid 93 is de-energized so that the sliding contact edge 78*b* on the right side of the swing lever 78 is separated from the circumferential face of the swing cam 81, the hot roller 31 and the pressure roller 32 can perform fixing onto recording paper.

Next, when a fixing operation is not performed, as show in FIG. 5, the solenoid 93 is energized so that the plunger 92 is pulled inside the solenoid 93. Accordingly, the control lever 91 rotates counterclockwise with the shaft 91*a* as the center. Thus, the pin 91*b* on the back side of one end of the control lever 91 goes up, enabling the swing lever 78 to rotate clockwise or counterclockwise. Then, the swing lever 78 rotates counterclockwise due to a biasing force applied by a spring (not shown). Consequently, the sliding contact edge 78*b* on the right side of the swing lever 78 abuts against the circumferential face of the swing cam 81.

In this state, when the hot roller 31 of the fixing apparatus 12 is driven to rotate, the drive gear 84 rotates so that the swing gear 82 and the swing cam 81 rotate. Consequently, the sliding contact edge 78*b* on the right side of the swing lever 78, which abuts against the circumferential face of the swing cam 81, repeatedly moves up and down. Thus, the swing lever 78 rotates clockwise and counterclockwise repeatedly with the shaft 76*a* of the pressure release cam 76 as the center.

Figure 9A:
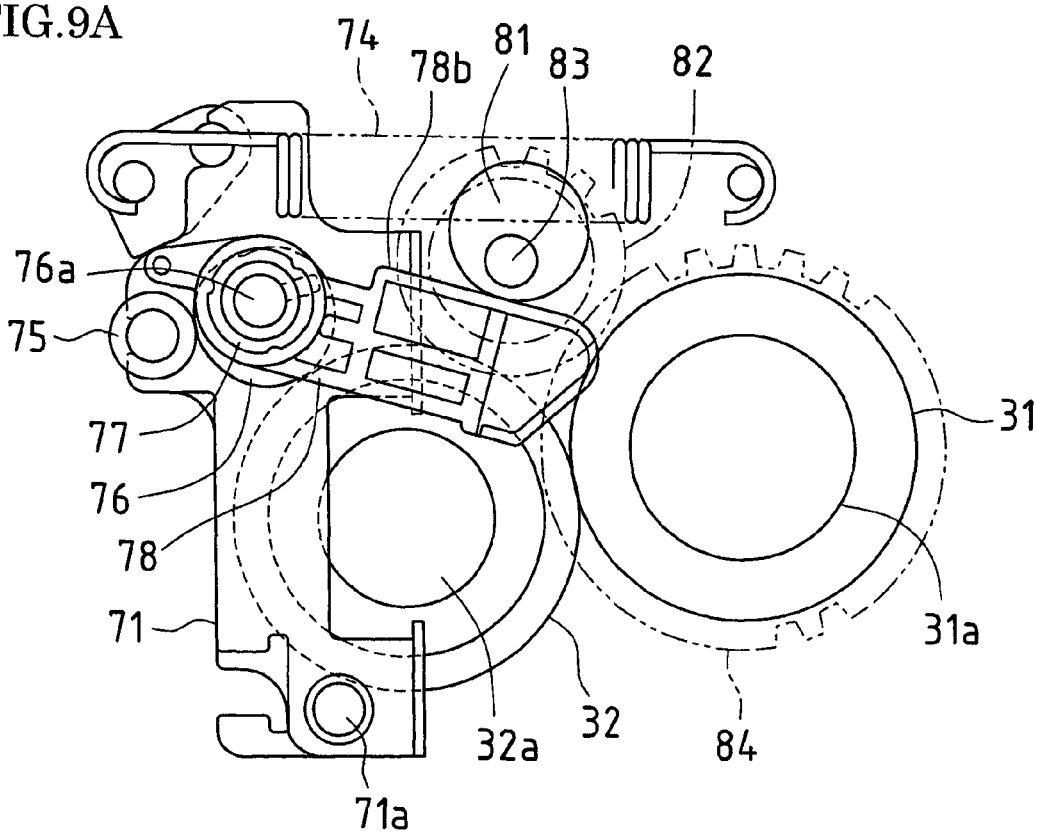
FIGS. 9A and 9B are diagrams showing operations of a swing lever and a pressure release cam shown in FIG. 3.

At this time, only the clockwise rotation of the swing lever 78 is transmitted to the shaft 76*a* of the pressure release cam 76 via the one-way clutch 77; thus, the clockwise rotation is intermittently transmitted to the shaft 76*a* of the pressure release cam 76. As a result of this, as shown in FIG. 9A, the pressure release cam 76 intermittently rotates clockwise.

Meanwhile, when the swing lever 78 rotates counterclockwise and the one-way clutch 77 idles, since the one-way clutch 97 for blocking reverse rotation on the body frame 79*b* side shown in FIG. 8 prohibits the shaft 76*a* of the pressure release cam 76 from rotating counterclockwise, the shaft 76*a* of the pressure release cam 76 will not rotate counterclockwise due to the influence of the counterclockwise rotation of the one-way clutch 77; thus, the pressure release cam 76 intermittently and reliably rotates clockwise.

Figure 9B:
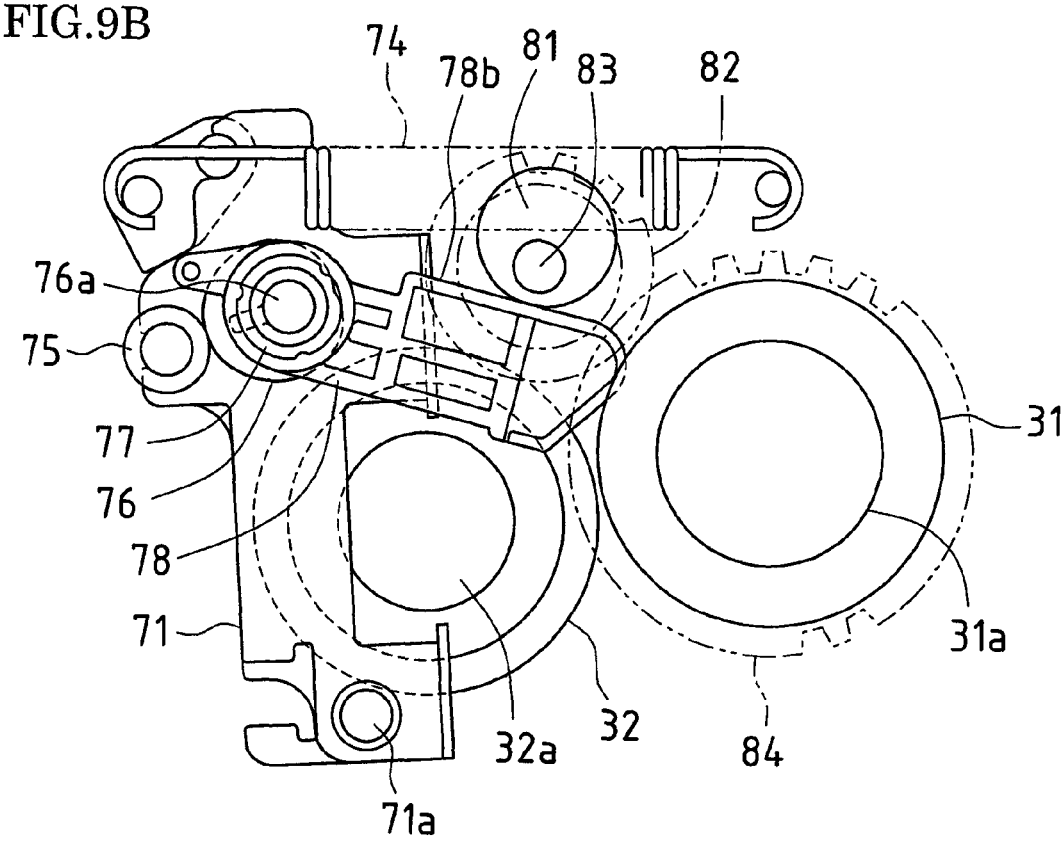

Further, as shown in FIG. 9B, when the pressure release cam 76 rotates clockwise 180 degrees around, the circumferential face on the long diameter side of the pressure release cam 76 pushes away the roller 75 of the displacement frame 71. Accordingly, the displacement frame 71 rotates and moves counterclockwise with the shaft 71*a* thereof as the center, so that the pressure roller 32 separates from the hot roller 31.

As described above, in a state in which the solenoid 93 is energized and the sliding contact edge 78*b* on the right side of the swing lever 78 is in contact with the circumferential face of the swing cam 81, when the hot roller 31 of the fixing apparatus 12 is driven to rotate, the swing lever 78 swings, and only the clockwise rotation of the swing lever 78 is transmitted to the shaft 76*a* of the pressure release cam 76 via the one-way clutch 77. Accordingly, the pressure release cam 76 intermittently rotates clockwise, and the circumferential face on the long diameter side of the pressure release cam 76 pushes away the roller 75 of the displacement frame 71, thereby separating the pressure roller 32 from the hot roller 31. As a result of this, deformation of the elastic layers of the hot roller 31 and the pressure roller 32 can be prevented.

Meanwhile, as shown in FIG. 3, when the circumferential face on the short diameter side of the pressure release cam 76 faces the roller 75 of the displacement frame 71 and the pressure roller 32 is pressed against the hot roller 31, as shown in FIG. 6, the notch portion 94*a* of the cam 94 faces downward, and the circumferential face of the cam 94 pushes up the sliding contact portion 96*b* of the detection member 96. Accordingly, the arc wall portion 96*c* of the detection member 96 moves up to and between the light emitting element 95*a* and the light receiving element 95*b* of the pressure control sensor 95, thereby blocking the space between the light emitting element 95*a* and the light receiving element 95*b*.

Also, as shown in FIG. 9B, when the circumferential face on the long diameter side of the pressure release cam 76 pushes away the roller 75 of the displacement frame 71, the displacement frame 71 rotates and moves counterclockwise with the shaft 71*a* thereof as the center so as to separate the pressure roller 32 from the hot roller 31. At this time, as shown in FIG. 7, the cam 94 also rotates 180 degrees around, and the notch portion 94*a* of the cam 94 faces upward. Consequently, the sliding contact portion 96*b* of the detection member 96 moves into the notch portion 94*a*, and the detection member 96 rotates around the shaft 96*a*. Accordingly, the arc wall portion 96*c* of the detection member 96 moves out of the space between the light emitting element 95*a* and the light receiving element 95*b*, thus releasing the space between the light emitting element 95*a* and light receiving element 95*b*.

Therefore, based on the light receiving output from the light receiving element 95*b* of the pressure control sensor 95, the rotational angle of the cam 94 and the pressure release cam 76 is detected. Thus, it can be determined whether or not the pressure roller 32 is in contact with the hot roller 31 from the rotational angle.

Furthermore, based on such a determination result, an operation to bring the pressure roller 32 into and out of contact with the hot roller 31 can be controlled.

For example, after the pressure roller 32 has been determined to be in contact with the hot roller 31 based on the light receiving output from the light receiving element 95*b* of the pressure control sensor 95, in a state in which the solenoid 93 is energized so that the sliding contact edge 78*b* on the right side of the swing lever 78 abuts against the circumferential face of the swing cam 81, the hot roller 31 of the fixing apparatus 12 is driven to rotate so that the swing cam 81 rotates, and then the swing lever 78 swings so that the pressure release cam 76 is intermittently rotated clockwise. Thereafter, the pressure release cam 76 is rotated until the circumferential face on the long diameter side of the pressure release cam 76 pushes away the roller 75 of the displacement frame 71, and the pressure roller 32 is determined to be separated from the hot roller 31 based on the light receiving output from the light receiving element 95*b* of the pressure control sensor 95. As a result of this, the hot roller 31 and the pressure roller 32 can be separated from each other.

When the fixing operation is re-started, in a state in which the solenoid 93 is energized so that the sliding contact edge 78*b* on the right side of the swing lever 78 abuts against the circumferential face of the swing cam 81, the hot roller 31 of the fixing apparatus 12 is driven to rotate so that the swing cam 81 rotates. Then, the swing lever 78 thereby swings so as to re-start intermittently rotating the pressure release cam 76 clockwise. Thereafter, the pressure release cam 76 is rotated until the circumferential face on the short diameter side of the pressure release cam 76 faces the roller 75 of the displacement frame 71, and the pressure roller 32 is determined to be pressed against the hot roller 31 based on the light receiving output from the light receiving element 95*b* of the pressure control sensor 95. After that, the swing lever 78 may be separated from the swing cam 81 by de-energizing the solenoid 93.

As described above, in the fixing apparatus 12 of the present embodiment, without changing the rotational direction of the hot roller 31 and the pressure roller 32, an operation to bring the pressure roller 32 into and out of contact with the hot roller 31 can be performed using the rotational driving force of the hot roller 31. As a result of this, even when a motor for driving the fixing apparatus 12 is used to drive the registration rollers 14 and the transport rollers 13, or the photosensitive drums 3 and the rollers of the development apparatuses 2, these rollers or the photosensitive drums will not rotate in reverse.

Furthermore, it is not necessary to mount a one-way clutch in a gear unit that transmits the rotational driving force from the driving motor to the hot roller 31 and the like; thus, the gear unit will not become complex.

Moreover, since the swing lever 78 can be brought into and out of contact with the swing cam 81, when performing a fixing operation, an operation to bring the pressure roller 32 into and out of contact with the hot roller 31 can be stopped by separating the swing lever 78 from the swing cam 81. Therefore, it is possible to switch and perform rotational driving of the hot roller 31 and the pressure roller 32 and an operation to bring the pressure roller 32 into and out of contact with the hot roller 31.

Although a preferred embodiment of the present invention has been described above with reference to the accompanying drawings, it goes without saying that the present invention is not limited to the above embodiment. As is clear for those skilled in the art, various changes or modifications will come within the scope of the claims, and it is understood that such changes or modifications also obviously fall within the technical scope of the present invention.

What is claimed is:

1. A fixing apparatus having a first roller and a second roller, a biasing portion that presses the first roller and the second roller against each other, and a driving portion that rotates the first roller and the second roller, and that sandwiches a recording material in a nip region between the first roller and the second roller and transports the recording material, the fixing apparatus comprising:

a swing cam that rotates in one direction by a rotational driving force provided by the driving portion being transmitted thereto;

a displacement support member that axially supports the second roller and displaces the second roller so that the second roller is brought into and out of contact with the first roller;

a pressure release cam that slidingly contacts the displacement support member;

a one-way clutch that is provided to a shaft of the pressure release cam; and a swing lever that is connected to the one-way clutch and is biased so as to slidingly contact the swing cam, wherein when the swing cam is rotated in one direction due to the rotational driving force provided by the driving portion, the swing lever that slidingly contacts the swing cam repeatedly swings, swinging the swing lever is transmitted via the one-way clutch to the pressure release cam as intermittent rotation in one direction, the pressure release cam pushes away the displacement support member, opposing a biasing force applied by the biasing portion, the displacement support member and the second roller are displaced, and the second roller is separated from the first roller.

2. The fixing apparatus according to claim 1, further comprising a control portion that is connected to the swing lever and moves the swing lever so that the swing lever separates from the swing cam.

3. The fixing apparatus according to claim 1, further comprising a reverse rotation blocking portion that blocks rotation of the shaft of the pressure release cam in an idling direction due to the rotation of the one-way clutch in the idling direction.

* * * * *